US009316220B2

(12) United States Patent
Noth et al.

(10) Patent No.: US 9,316,220 B2
(45) Date of Patent: Apr. 19, 2016

(54) ELECTRONIC CONTROL METHOD AND SYSTEM FOR A PIEZO-ELECTRIC PUMP

(75) Inventors: André Noth, Lausanne (CH); Eric Chappel, Versonnex (FR)

(73) Assignee: DEBIOTECH S.A., Lausanne (CH)

( * ) Notice: Subject to any disclaimer, the term of this patent is extended or adjusted under 35 U.S.C. 154(b) by 205 days.

(21) Appl. No.: 13/997,523

(22) PCT Filed: Dec. 19, 2011

(86) PCT No.: PCT/IB2011/055771

§ 371 (c)(1),
(2), (4) Date: Jun. 24, 2013

(87) PCT Pub. No.: WO2012/085814

PCT Pub. Date: Jun. 28, 2012

(65) Prior Publication Data

US 2013/0272902 A1 Oct. 17, 2013

(30) Foreign Application Priority Data

Dec. 23, 2010 (EP) ..... 10196809

(51) Int. Cl.
*F04B 49/00* (2006.01)
*F04B 49/06* (2006.01)
(Continued)

(52) U.S. Cl.
CPC ..... *F04B 49/00* (2013.01); *F04B 43/0081* (2013.01); *F04B 43/046* (2013.01); *F04B 49/065* (2013.01)

(58) Field of Classification Search
CPC ..... F04B 43/046; F04B 49/12; F04B 49/14; F04B 49/06; F04B 49/065; F04B 43/043
USPC ..... 417/44.11, 413.2, 417, 413.1; 310/317, 310/316.01; 318/114, 119
See application file for complete search history.

(56) References Cited

U.S. PATENT DOCUMENTS 4,939,405 A * 7/1990 Okuyama ..... F04B 43/046 310/317
5,029,805 A * 7/1991 Albarda ..... B41J 2/17596 251/11
5,085,562 A * 2/1992 van Lintel ..... F04B 43/046 417/412

(Continued)

FOREIGN PATENT DOCUMENTS

JP 62-186077 A 8/1987
JP 2001-132646 A 5/2001

(Continued)

OTHER PUBLICATIONS

International Search Report for PCT/IB2011/055771, mailed Nov. 6, 2012.

(Continued)

*Primary Examiner* — Alexander Comley
(74) *Attorney, Agent, or Firm* — Nixon & Vanderhye P.C.

(57) ABSTRACT

A method actuates a pumping device that has an optimal driving voltage. The pumping device includes a pumping chamber that has a pumping membrane, an inlet and an outlet chamber, a voltage controlled actuator connected to the pumping membrane, a stop position defined by a mechanical stop, and a sensor for determining whether the pumping membrane has reached the mechanical stop. The method performs a learning and working phase. The learning phase is adapted to determine the optimal driving voltage.

18 Claims, 8 Drawing Sheets

(51) Int. Cl.
*F04B 43/04* (2006.01)
*F04B 43/00* (2006.01)

(56) References Cited

U.S. PATENT DOCUMENTS 5,130,598 A * 7/1992 Verheyen ..... F02D 41/2096 310/316.03
5,271,724 A * 12/1993 van Lintel ..... F15C 5/00 137/554
5,342,176 A * 8/1994 Redlich ..... F04B 35/045 318/687
5,725,363 A * 3/1998 Bustgens ..... F04B 43/043 417/207
5,759,015 A * 6/1998 Van Lintel ..... F04B 43/046 417/322
5,897,296 A * 4/1999 Yamamoto ..... F04B 35/04 417/1
5,945,768 A * 8/1999 Treu, Jr. ..... H02N 2/147 310/316.01
6,033,191 A * 3/2000 Kamper ..... F04B 43/043 417/322
6,109,889 A * 8/2000 Zengerle ..... F04B 43/046 417/413.2
6,176,683 B1 * 1/2001 Yang ..... F04B 35/045 417/44.1
6,280,148 B1 * 8/2001 Zengerle ..... H01L 41/00 417/212
6,536,326 B2 * 3/2003 Unger ..... F02B 71/00 91/361
6,663,348 B2 * 12/2003 Schwarz ..... F04B 35/045 417/12
6,857,857 B2 * 2/2005 Dovey ..... F04B 35/045 417/415
7,090,470 B2 * 8/2006 Kim ..... F04B 35/045 318/432
7,198,250 B2 * 4/2007 East ..... F04B 43/046 251/129.06
7,199,503 B2 * 4/2007 Ollila ..... H02N 2/0015 310/316.03
7,312,554 B2 * 12/2007 Vogeley ..... F04B 43/046 310/316.01
7,372,187 B2 * 5/2008 Augesky ..... H02N 2/067 310/316.03
7,845,912 B2 * 12/2010 Sung ..... F04B 35/045 318/119
2002/0114716 A1 * 8/2002 Takagi ..... F04B 11/0008 417/413.2
2002/0175597 A1 * 11/2002 Raman ..... H01L 41/08 310/328
2003/0067247 A1 * 4/2003 Jansen ..... F04B 43/046 310/317
2004/0018100 A1 * 1/2004 Takagi ..... F04B 49/065 417/322
2004/0169436 A1 * 9/2004 Fukagawa ..... H01L 41/042 310/317
2005/0235732 A1 * 10/2005 Rush ..... A61M 5/14216 73/1.16
2005/0244288 A1 * 11/2005 O'Neill ..... F04B 43/043 417/413.2
2006/0013710 A1 * 1/2006 Lee ..... A61M 5/14276 417/413.1
2007/0040454 A1 * 2/2007 Freudenberger ..... F04B 17/042 310/12.04
2007/0276544 A1 * 11/2007 Dainez ..... F04B 35/045 700/281
2009/0015097 A1 * 1/2009 Meng ..... H02N 2/14 310/317
2009/0095821 A1 * 4/2009 Feriani ..... H01L 41/042 239/74
2009/0167109 A1 * 7/2009 Tomita ..... F04B 43/046 310/317
2013/0272902 A1 * 10/2013 Noth ..... F04B 43/046 417/53

FOREIGN PATENT DOCUMENTS

JP 2001-507425 A 6/2001
JP 2004-308465 A 11/2004
WO WO 2009052842 A1 * 4/2009 ..... F04B 43/046

OTHER PUBLICATIONS

Written Opinion of the International Searching Authority for PCT/IB2011/055771, mailed Nov. 6, 2012.
Notice of Reasons for Rejection mailed Sep. 1, 2015, issued in corresponding Japanese Patent Application No. 2013-545601 and English translation.

* cited by examiner

ELECTRONIC CONTROL METHOD AND SYSTEM FOR A PIEZO-ELECTRIC PUMP

This application is the U.S. national phase of International Application No. PCT/IB2011/055771, filed 19 Dec. 2011, which designated the U.S. and claims priority to EP Application No. 10196809.7, filed 23 Dec. 2010, the entire contents of each of which are hereby incorporated by reference.

FIELD OF THE INVENTION

The present invention concerns an electronic control system and a smart process to optimise the power consumption of a micropump (for example a piezoelectric micropump) and to verify the reliability of the pumping mechanism in functioning, typically by analysing the signals of two integrated detectors as a function of the actuator voltage.

Lifetime of the batteries is one of the most sensitive limitations for portable medical devices like insulin pumps and other similar devices. It is defined as the ratio between battery capacity and power consumption. Considering a defined battery, its lifetime can only be increased by reducing the power consumption of the device powered by said battery.

In most membrane pumps, the pumping membrane is over-actuated against precise mechanical stops, in order to have an excellent repeatability and a pumping precision by controlling the stroke volume (see for example EP 0 737 273).

In the particular case of a piezoelectric actuator, the maximum voltage is set to compensate misalignments of the actuator and also to ensure the pumped volume does not depend on environmental conditions. Despite all the variations and uncertainties related to tolerances, the actuated membrane should always reach the same amplitude. However, it is clear that the larger the safety margin, the larger the voltage applied, and therefore the larger the power consumption.

STATE OF THE ART

The patent application WO 03/023226 A1 (applicant: Medtronic Minimed Inc.) presents an electronic control systems and process for infusion devices and pump configurations that can provide a highly efficient use of electrical power.

In this prior art, the system may include a capacitor, which is controlled to partially, but not fully discharge, to provide a power pulse to a pump coil. A power cut-off switch may be provided to control the discharge of the capacitor such that the capacitor is stopped from discharging prior to the actual end of the armature stroke. The time at which the capacitor discharge is stopped may be selected such that energy remaining in the coil after the capacitor stops discharging is sufficient to continue the pump stroke to the actual end of the stroke. A power disconnect switch may be provided between the capacitor and the battery, to allow the capacitor to be electrically disconnected from the battery during storage or other periods of non-use.

Document US 2009/0140185 discloses a system and method to improve and optimize the flow rate accuracy of a fluidic delivery system, for example an implantable drug infusion delivery system, whereby the desired flow rate is achieved by varying the duty cycle of the valve. The disclosed valve assembly comprises a piston that is actuated by a piezoelectric actuator, the movement of the piston allowing fluid (e.g. a drug in liquid form) supplied to an inlet passage moving past piston via a groove to enter a collection space at the other end of the piston and then, from there, to be forced into an outlet passage and eventually directed to site of interest, such as a desired treatment area of a patient. The downward movement of the piston is controlled by applying a specific electric signal to the piezoelectric actuator which as a result deforms with a slight downward displacement.

A desired constant flow rate of fluid delivered can be defined by varying the duty cycle, i.e. the ratio of valve opened time to the valve closed time.

Other prior art publications relating to similar pumps are for example U.S. Pat. No. 5,759,015, WO 01/90577, EP 1 839 695 and EP 2 059 283 and WO 2010/046728 all incorporated by reference in the present application as regards the construction of such pumps.

GENERAL DESCRIPTION OF THE INVENTION

EP application No. 09178168.2 filed on Dec. 7, 2009 by the same Applicant as the present application discloses a flexible element for micro-pump which may be actuated by a piezoelectric element. This earlier application is incorporated in its entirety in the present application as regards the description of micro-pumps actuated by a piezoelectric element.

Considering piezoelectric actuated reciprocating membrane pump including a sensor, as for example disclosed in EP 09178168.2 mentioned here above, the present invention provides an improved method and control system able to minimize the driving voltage of an actuator based on the measurements of at least one embedded sensor, in order make the pumping membrane of a medical device reach a defined position, with the following targets:

- reduce the power consumption of the pumping device by supplying the minimum voltage, while maintaining a precise pumping volume.
- determine the reliability of the actuator and control the mechanical stability of the pumping system during the device life by analyzing if this optimal actuation voltage varies during the life cycle of the device.

Preferably, the defined position corresponds to one or more mechanical stops that limit the stroke of the pumping membrane.

Preferably, the actuator is a piezoelectric actuator.

Preferably, the optimum voltage is reached through a learning process.

Preferably, the learning process necessary to determine this optimal actuation voltage is done during the first pumping stroke but can be also performed:

- during several initial pumping strokes
- in a repetitive manner according to a predefined frequency
- continuously Preferably, one of the sensor used is:

- a pressure sensor placed on the fluidic path, more specifically in the pumping chamber located between an inlet chamber and an outlet chamber, which comprise preferably valves or flow restrictors or combination of both.
- a proximity sensor for detecting the membrane position, it could be capacitive, resistive, magnetic, inductive or optical
- a strain gauge placed on the mechanical stop, or on the membrane or on the actuator Of course, the preferred embodiments mentioned above are only possible examples of realization and should not be construed in a limiting manner.

BRIEF DESCRIPTION OF THE DRAWINGS

The present invention and its embodiments will be better understood from the following detailed description and drawings of illustrative embodiments of the invention, in which.

DETAILED DESCRIPTION OF THE INVENTION

Description of the Pump

Figure 1A:
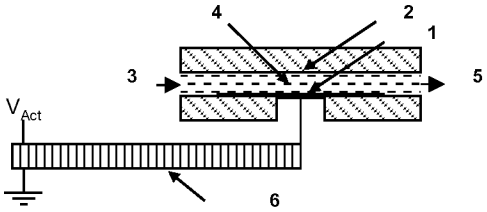
FIG. 1*a* illustrates a schematic construction of the pump according to the present invention.

In order to clearly define the innovation, we will describe the different element composing the pump system (typically for example as disclosed in EP 09178168.2 incorporated in its entirety in the present application) by reference to FIG. 1*a:*

1. A Pumping Membrane (1), which has to reach one or several clearly defined positions, possibly mechanically defined by Mechanical Stops (2) (or mechanical limiter).
2. A fluidic pathway made of:
   - an Inlet Chamber (3), comprising for example a valve or a flow restrictor,
   - a Pumping Chamber (4),
   - a first sensor,
   - an Outlet Chamber (5), comprising for example a valve or a flow restrictor,
   - a second sensor and
   - a fluidic restriction.
3. A substrate that is used as support
4. An actuator, for example a Piezoelectric Actuator (6), which actuates the Pumping Membrane (1) but is not necessarily tightly linked to it. This Piezoelectric actuator (6) is driven with a certain voltage, for example a ramp from 0 to $V_{Act\ Max}$. A bender (Cantilever) is used for the following description, but other forms or type or configuration of piezoelectric actuator can be used in the same way (plate, ring, plate stacks, ring stacks, plate benders, ring benders, shear plates, monomorph, multimorph etc.) as well as other types of smart actuators such as stacks of shape memory alloys (SMA) and polymers (SMP), electrostrictive or magnetostrictive actuators.

Figure 1B:
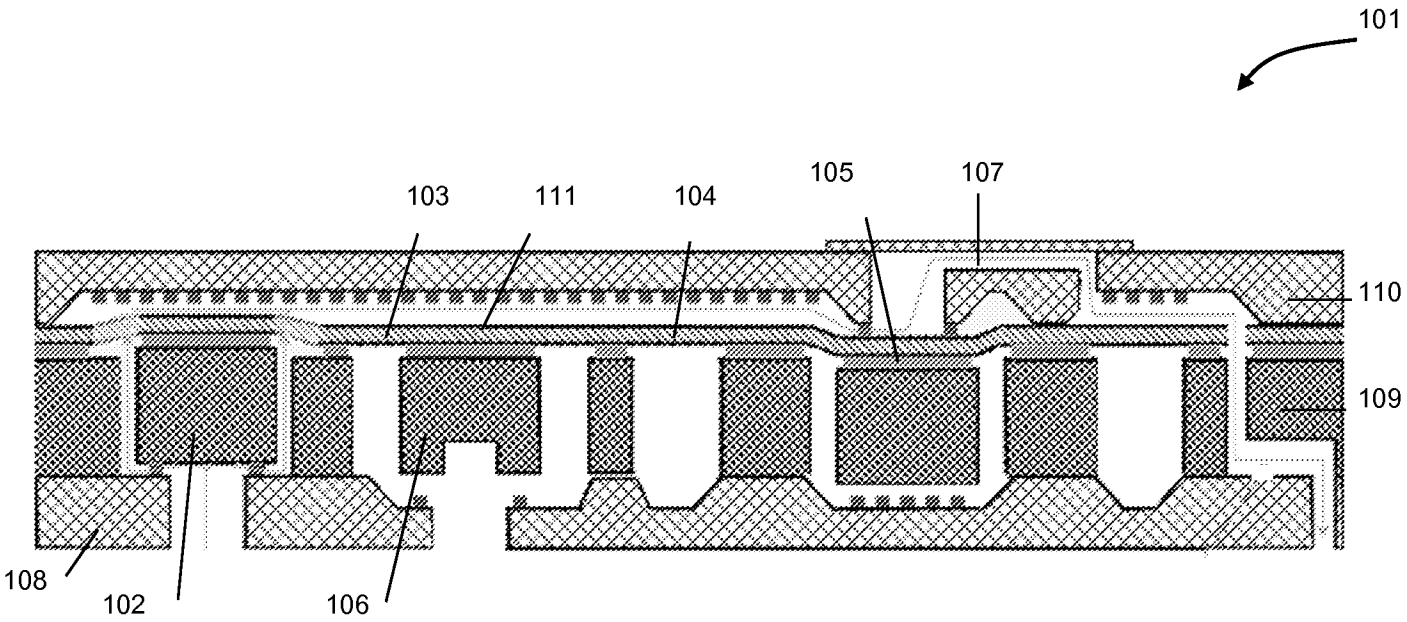
FIG. 1*b* illustrates a schematic view of the preferred embodiment of the pump according to the present invention

Such highly miniaturized and reciprocating membrane pumping mechanisms are preferably made in silicon using MEMS techniques according to the prior art cited here above. In such preferred embodiment, the micro-pump (101) as illustrated in FIG. 1*b* is made from silicon or glass or both, using technologies referred to as MEMS (Micro-Electro-Mechanical System). It contains an inlet control member, here an inlet valve (102), a pumping membrane (103), a functional sensor (104) which allows detection of various failures in the system and an outlet valve (105). The principle of such micro-pumps is known in the prior art, for example from U.S. Pat. No. 5,759,014.

FIG. 1*b* illustrates a pump (101) with the stack of a first silicon layer as base plate (108), a second silicon layer as second plate (109), secured to the base plate (108), and a third silicon layer (110) as a top plate, secured to the silicon plate (109), thereby defining a pumping chamber (111) having a volume.

An actuator (not represented here) linked to the mesa (106) allows the controlled displacement of the pumping membrane (103). The pumping membrane (103) displacement is limited, in the upward direction, by the plate (110) which corresponds to the mechanical stop (2) of the FIG. 1*a*, and in the downward direction by the plate (108) which corresponds to a second mechanical stop not represented in FIG. 1*a*. A channel (107) is also present in order to connect the outlet control member, the outlet valve (105) to the outlet port placed on the opposite side of the pump. A second functional sensor (not represented here) is placed in the fluidic pathway downstream the outlet control member.

The inlet (3, 102) of the pumping mechanism is connected to a liquid reservoir that should comprise a filter while the outlet (5, 105) is connected to a patient via a fluidic pathway that should comprise valves or flow restrictors, pressure sensor, air sensor, flowmeter, filter, vent, septum, skin patch, needles and any other accessories.

The Sensor (104) measures defined characteristics of the pump stroke. These characteristics can be the pressure at one or multiple points of the system, as integrated in known pump design (see publication WO 2010/046728) but can be, for example:

1. A pressure sensor placed along the fluidic path
2. A proximity sensor, for detecting the membrane position, which could be capacitive, resistive, magnetic, inductive or optical.
3. A strain gauge placed
   - On the Mechanical Stop (2)
   - On the Pumping Membrane (1)
   - On the Piezoelectric Actuator (6)

In one embodiment, the sensor (104) is preferably a pressure sensor placed within the pumping chamber cavity (111) and between the inlet chamber (102) and the outlet chamber (105). These inlet (102) and outlet (105) can be valves preferably passive, or flow restrictors. For MEMS micropumps, the pressure sensor (104) could be made of a silicon flexible membrane comprising a set of strain sensitive resistors in a Wheatstone bridge configuration, making use of the huge piezo-resistive effect of the silicon. A change of pressure induces a distortion of the membrane and therefore the bridge is no longer in equilibrium. The sensor (104) is designed to make the signal linear with the pressure within the typical pressure range of the micropump (101). The sensor backside can be vented for differential pressure measurement or sealed under vacuum for absolute pressure measurements. The membrane of the sensor (104) is preferably circular or square shaped. Depending on the micropump structure, the strain gauges and the interconnection leads may be implanted on the sensor surface which is intended to be in contact with the pumped liquid. To ensure a good electrical insulation of the sensor (104), a protective and insulating layer shall be used. Alternatively, an additional sensor surface doping of polarity opposite to that of the leads and the piezo-resistors could be used to prevent current leakage.

The very low compressibility of the silicon micropump (101) coupled to the small pumping cavity volume (111) (few hundreds of nanoliters) and the high compression ratio (up to 2 or more) make the pressure sensor placed within the pumping cavity (111) very sensitive to change of pressure as low as 1 mbar. This sensor (104) is suitable to detect very small change of the pumping membrane (103) position (fractions of microns) during the actuation phases as described hereafter. More details on the integrated pressure sensor (104) capabilities are given in the document WO2010046728.

Figure 2:
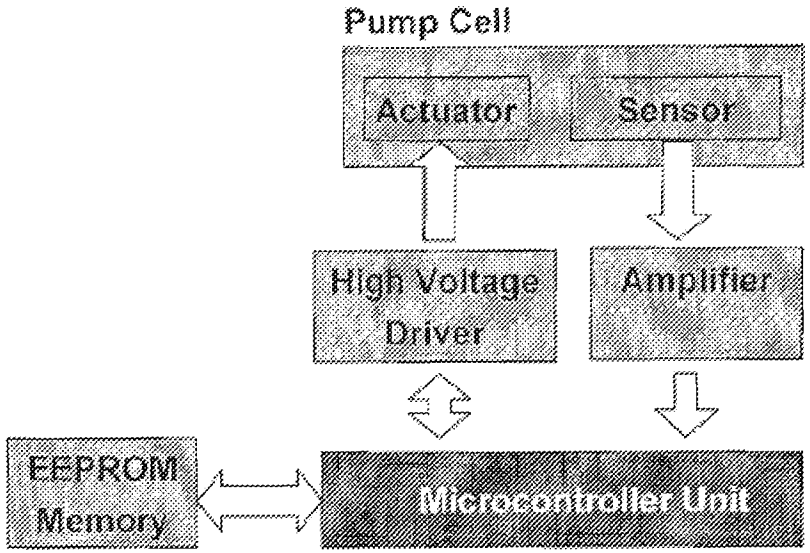
FIG. 2 illustrates a schematic construction of the pump control system.

At a higher level, the control system of the pump is composed of the following elements, as represented on FIG. 2:

1. A high voltage driver for driving the piezoelectric actuator
2. An amplifier for the treatments of the signal coming from the sensor(s).
3. A microcontroller that controls the high voltage driver and receives the sensor(s) signal(s)
4. A memory, for example a non-volatile EEPROM or the internal microcontroller flash or RAM memory, in which the microcontroller can store data and settings (applied voltage, sensor data, set values etc)

Definition of the Optimal Voltage $V_{Act\ Optimal}$

An idea of the present invention is to determine the minimal actuation voltage that, should be applied to the piezoelectric actuator to ensure the pumping membrane (1) reaches the mechanical stop(s) (2). After contact, the mechanical stop(s) (2) is (are) pushed ideally with a force equal to zero, or with a minimal force only high enough to withstand a pressure exerted on the membrane (1). Hereafter, this minimum voltage is referred to as the optimal voltage and labelled $V_{Act\ Optimal}$.

Figure 3:
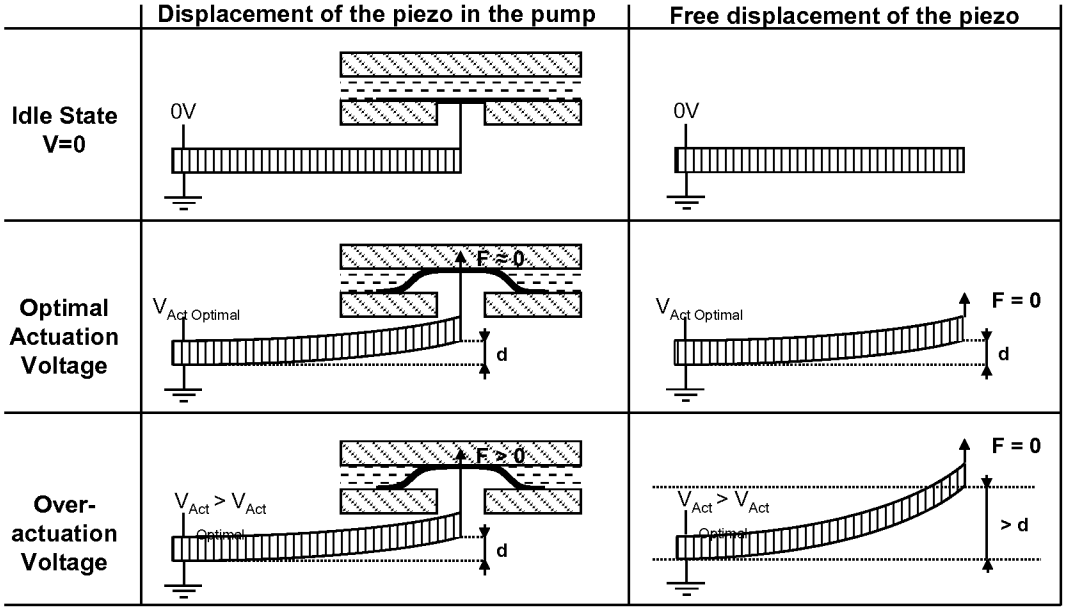
FIG. 3 illustrates a representation of the optimal pump state, with idle and over-actuation states.

This behaviour illustrated by FIG. 3 which shows the different states of the device: in the left column the device according to the invention and in the right column the free displacement of the piezoelectric actuator (6) alone for the sake of explanation and illustration.

More specifically, the two figures on the first line (left and right column) illustrate the idle state where the applied voltage is equal to zero (V=0). The piezoelectric actuator (6) does not move and the membrane (1) is not displaced. The fluidic pathway is therefore "open".

On the second line, the illustrated behaviour is the one where the optimal actuation voltage is used, i.e. where the displacement "d" of the piezoelectric actuator corresponds exactly to the necessary distance for the membrane (1) to reach the desired mechanical stop (2), i.e. the distance "d". This is the behaviour one tries to reach in the present invention. As illustrated in the right column, the free displacement of the actuator also corresponds to the distance "d".

On the third line, an over-actuation behaviour (and voltage) is illustrated. In this configuration, the voltage used is higher than the optimum value so that the displacement of the actuator (6) is over the distance "d" (as illustrated in the drawing of the right column). In this case, energy is lost because the system has a mechanical stop that will block the movement of the actuator and the membrane (1) would have reached this mechanical stop using a lower voltage, for example the optimal actuation voltage.

It is therefore an aim to be able to determine the optimal actuation voltage that is necessary for the device to function properly as illustrated in the second line of FIG. 3 and avoid the behaviour of the third line (over-actuation).

Objectives of Using $V_{Act\ Optimal}$

There are mainly three objectives in the present invention, which will be detailed hereafter:

1. Reduction of power consumption
2. Determination of the reliability of piezoelectric actuation
3. Calculation of pumping membrane offset This invention allows the reduction of power consumption in a system that uses piezoelectric actuators by applying the lowest voltage necessary. The energy required for the actuation of the piezoelectric actuator can be calculated using the capacitor equivalent model:

$$E_{Piezo}=\tfrac{1}{2}CV^2$$

Where C is the piezoelectric actuator capacity and V the voltage applied. This formula demonstrates that a 50% voltage reduction decrease the energy by a factor of 4, a 29.3% voltage reduction leads to a factor of 2.

This invention is also powerful to determine the reliability of the actuator during pumping.

For example, the assembly of a piezoelectric actuator (6) includes a mechanical loop made of: a substrate, a pump, an actuator and a flexible link between the pumping membrane (1) and this actuator (6) (See the application EP09178168.2). These different elements are typically glued together. During the normal use of the pump, these glues undergo high stresses which can lead to a failure of this mechanical loop and thus of the pump itself. A typical failure is the delamination of the piezoelectric actuator (6). This delamination is progressive and often very difficult to observe before the complete failure: the overdriving of the piezoelectric actuator (6) compensates at least at the beginning the delamination of the actuator (6). For portable drug infusion system, a method that can help to identify the beginning of the failure is desirable.

In one embodiment described below, the learning phase comprises the recording first of the nominal values of the pressure sensors at the maximum voltage. Then the voltage is decreased and the signals are monitored up to a significant change in the detector signals, indicating the mechanical stops (2) are not reached.

We assume first that the mechanical loop is functional before the first start of the pump. During the priming of the pump the learning phase can be achieved. It is important to note that a second pressure sensor located after the chamber outlet can be used as a flowmeter since the integral of its signal is proportional, for a given temperature, to the flow rate. Therefore we assume that the nominal signal of the second detector at the maximum voltage $V_{max}$ is representative of the nominal stroke volume of the pump, i.e. when the two mechanical stops are reached by the pumping membrane during the actuation.

By reducing step by step the actuation voltage and by monitoring the signal of the pressure sensor (104), it is possible to detect a minimum (and thus optimal) voltage $V_{Act\ Optimal}$ necessary to reach the nominal stroke volume.

It is obvious that this $V_{Act\ Optimal}$ depends on the reliability of the mechanical loop, any delaminating will increases the value of $V_{Act\ Optimal}$. This method is very sensitive and reliable because the overdriving of the piezoelectric actuator (6) is bypassed and also because we have a direct access to the stroke volume, which is the more relevant value in terms of safety and reliability.

In practice, a functional reliability test consists of the checking of the pressure signals amplitude by using an actuation voltage slightly larger than $V_{Act\ Optimal}$.

The first pressure sensor (104) located within the pumping chamber (4, 111) should also be used for this process.

It is also important to note that the rest position of the membrane (no voltage on the piezoelectric actuator electrodes) can be located anywhere between the upper and the lower mechanical stops. In the most general case, the amplitudes of the strokes from the rest position to the mechanical stops are not symmetric. This dissymmetry can be due to the design itself, the machining and assembly tolerances and also misalignments. If dissymmetric strokes are not expected by design, it is relevant to estimate the minimum voltage necessary to reach the mechanical stop (2) in both directions, in order to reduce the power consumption. The actuator (6) can be advantageously made of a bimorph or a multimorph piezoelectric actuator that allow large bi-directional deflections and large forces. In that configuration the assembly may induce dissymmetry, typically by using glues for the mechanical loop. It could be therefore useful to determine the offset in the position of the membrane (1) at the rest position to optimize the actuator power consumption. The maximum voltages for the two strokes $V_{Act\ max\ (up)}$ and $V_{Act\ max\ (down)}$ are equal to $V_{Act\ max}$ in absolute value at the beginning. In practice, the test consists of checking the pressure signal amplitude by reducing first only $V_{Act\ (up)}$ in order to determine $V_{Act\ Optimal\ (up)}$, and then $V_{Act\ (up)}$ is set again at $V_{Act\ max}$ and now $V_{Act\ (down)}$ is varied to determine $V_{Act\ Optimal\ (down)}$.

It is important to note that the idle position of the membrane (1) and the minimum force necessary to reach the mechanical stops (2) not only depend on mechanical assembly or machining tolerances but also on environmental conditions. The usual over-driving of the pumping actuators typically prevents under infusion due to these effects but it is not efficient in term of energy consumption. The typical range of pressure variations depends on the foreseen application. For medical application, considering for instance insulin pumps having infusion lines, the head height of the liquid in the infusion line has a major influence on the pressure at the outlet of the pumping chamber. The pumping mechanism should overcome this additional pressure to ensure a correct infusion volume. In such devices having long infusion lines, the overdriving voltage may be as high as two times the minimum voltage necessary to reach the mechanical stop (2) in normal conditions.

The use of the preferred embodiment of the present method (an integrated silicon sensor (104) located within the pumping chamber (111) and between a chamber inlet (102) and a chamber outlet (105), preferably two valves and more specifically two check valves as depicted in FIG. 1 *b*) is very powerful to limit the power consumption of the actuator (6) because it is possible to anticipate the effect of head height or any external pressure changes by the pressure measurements itself before or during or after the pumping cycle. An additional pressure sensor located downstream the chamber outlet (105) can be also used to that end.

For non-continuous monitoring of the full stroke completion, a safety margin shall be implemented for the optimal voltage to prevent infusion errors due to environmental condition changes that are not monitored via dedicated sensors like thermometers or pressure sensors.

Finally, present invention allows the calculation of the pumping membrane offset by knowing the piezoelectric actuator (6) characteristics and the voltage that is necessary to reach one or several mechanical stops (2). The sub-micron determination of the membrane (103) offset with the integrated pressure sensor (104) in silicon micropump is a smart, accurate, efficient, compact and low cost alternative to other measurement means like optical sensors or proximity sensors.

Method to Determine $V_{Act\ Optimal}$

Figure 4:
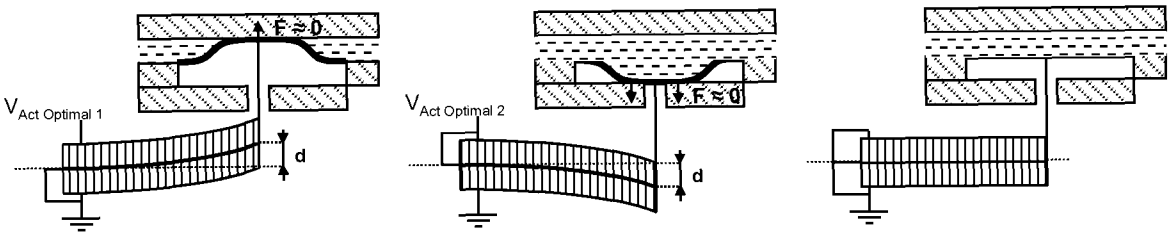
FIG. 4 illustrates examples of actuation of the pump with two mechanical stops and two optimal voltages.

In the further description, the principle will be explained for a single mechanical stop (2). However, the same principle can be extended to systems with two mechanical stops (see FIG. 4) or multiple mechanical stops. For each mechanical stop i, an optimal voltage $V_{Act\ Optimal\ i}$ can be determined using the same approach. It is possible to measure the optimal voltage values during the manufacturing process and store them in a memory of the device, for example an EEPROM or another equivalent device as described in FIG. 2.

In order to determine the optimal actuation voltage of a system, different methods are proposed as examples in the following paragraphs.

Method 1: Multi Strokes Top-Down Learning Method

Figure 5:
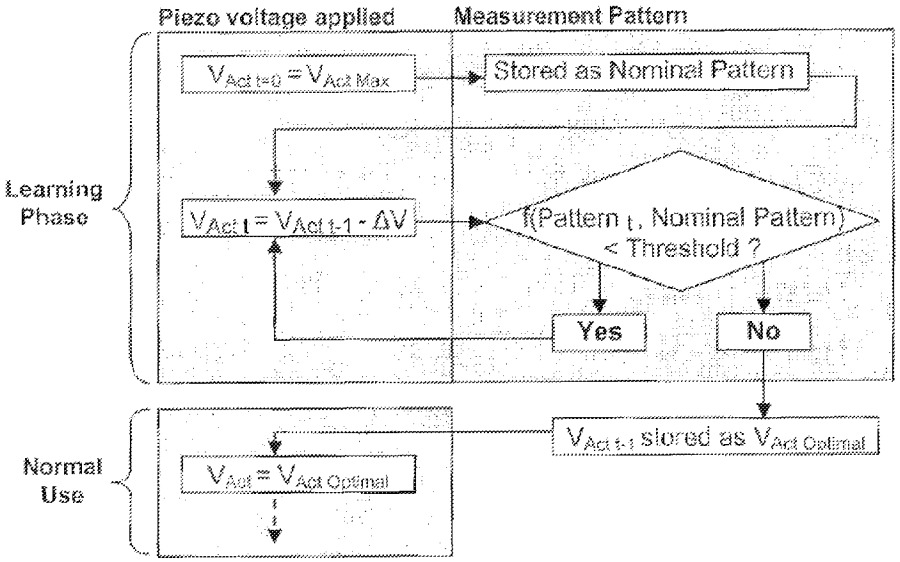
FIG. 5 represents a schematic description of a first algorithm according to the present invention.
Figure 6:
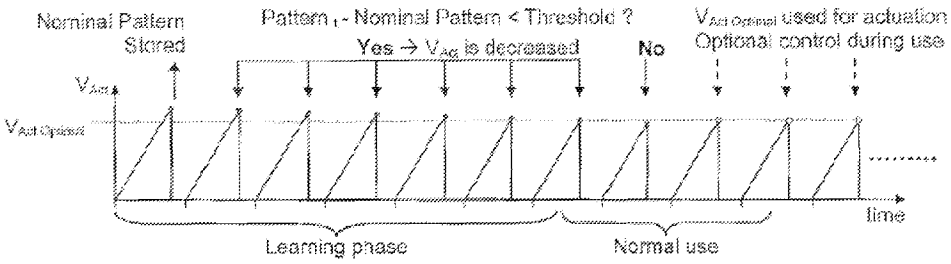
FIG. 6 represents the evolution of voltage ramps with convergence to $V_{act\ optimal}$ according to the first algorithm.

The first method is implemented as follows (see FIGS. 5 and 6):

1. For the first stroke(s) of a new pump, a maximum actuation voltage $V_{Act\ Max}$ is applied to the Piezoelectric Actuator (6), which ensures by design (over dimensioning) that the mechanical stops 2 are reached by the Pump Membrane (1), and thus the pumping process is optimal concerning precision.
2. The Sensing Device (e.g. 104) is enabled, simultaneously or not to the pumping process, to record along time one or multiple data points, for example corresponding to a pressure or a volume of liquid. These data form a Nominal Pattern that corresponds to a nominal stroke.
3. For the following strokes, the actuation voltage $V_{Act}$ is decreased progressively with a predefined step $\Delta V$. Each time, the measured pattern is compared to the Nominal Pattern, which allows detecting if the membrane reached the Mechanical Stops (2) or not.
4. When the difference between the measured and Nominal Pattern is higher than a defined threshold, it is clearly established that the membrane has not reached the mechanical stop (2) position anymore. Thus, the last voltage value is said to be the lowest voltage leading to a correct and precise pump stroke, and it is stored as $V_{Act\ Optimal} < V_{Act\ Max}$.
5. For all the following strokes, $V_{Act\ Optimal}$ voltage (as determined above) is used, thus ensuring a minimum power consumption and an optimal pumping.

The points 1-4 form a Learning Phase which is used to precisely determine the optimal energy (i.e. actuation voltage) necessary. This Learning Phase can be executed during the priming of the pump. Also, as it can be repeated periodically to take physical changes of the system (fatigue, mechanical deformation, modification of environmental conditions . . . ) into account or even to adapt to a changing environment.

Method 2: Single Stroke Bottom-Up Learning Method

Figure 7:
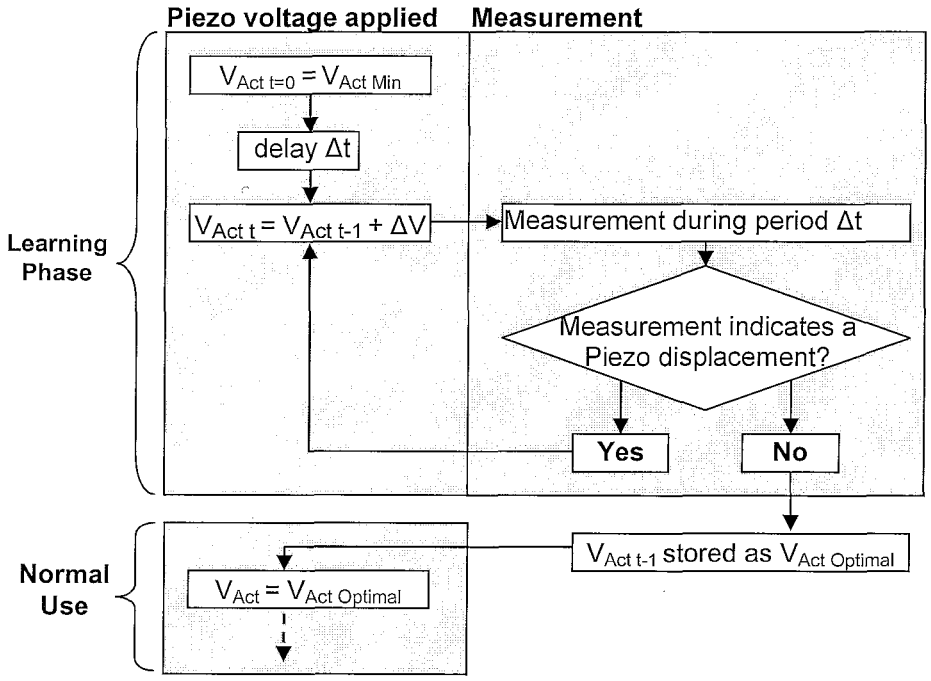
FIG. 7 represents a schematic description of a second algorithm according to the present invention.
Figure 8:
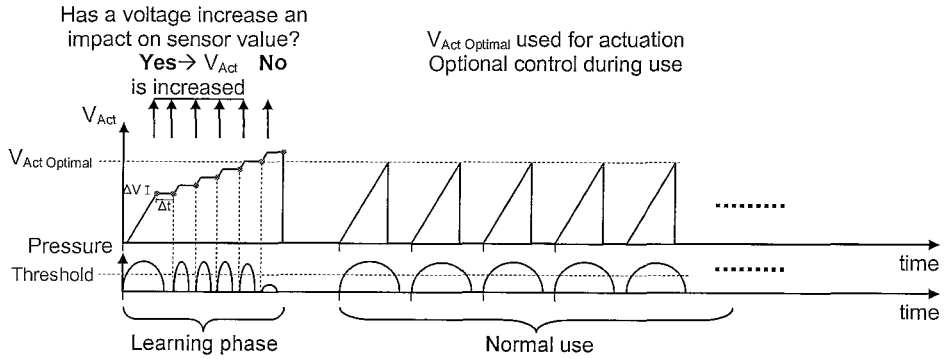
FIG. 8 represents the evolution of voltage ramps with convergence to $V_{act\ optimal}$ according to the second algorithm.

The bottom-up method is implemented as follows (see FIGS. 7 and 8):

1. For the first stroke of a new pump, a minimum actuation voltage $V_{Act\ Min}$ is applied to the Piezoelectric Actuator (6), which ensures the mechanical stops (2) is not reached by the Membrane (1).
2. After a certain time period $\Delta t$ that ensures mechanical stabilization of the system, an increase of voltage $\Delta V$ is applied.
3. Simultaneously or not to the voltage increase, the Sensing Device is enabled to record along time one or multiple data points.
4. These data are then processed to determine if the voltage increase induced a displacement of the piezoelectric actuator (6). If yes, this means that the mechanical stop (2) was not reached yet because the piezoelectric actuator has moved following two successive voltage increase and the process restarts at point 2.
5. If no displacement was sensed, one concludes that the piezoelectric actuator 6 reached the mechanical stop (2) so that voltage increases have no effect. Hence, the last voltage increase was useless, and the precedent voltage value is attributed to $V_{Act\ Optimal}$.

6. For all the following strokes, $V_{Act\ Optimal}$ voltage (as determined above) is used, thus ensuring a minimum power consumption and an optimal pumping.

Method 3: Single Stroke Top-Down Learning Method

Figure 9:
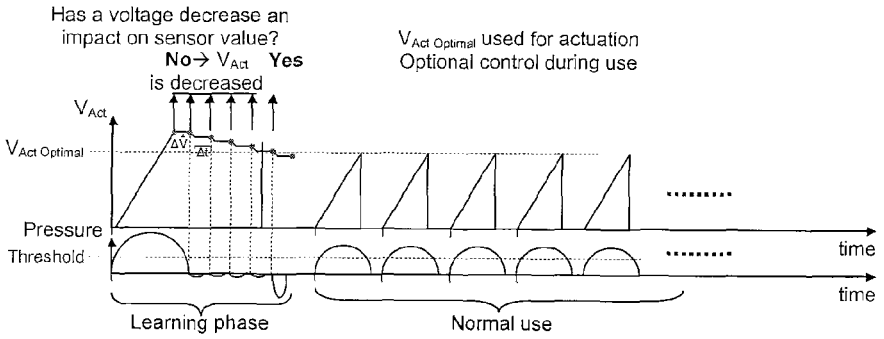
FIG. 9 represents the evolution of voltage ramps with convergence to $V_{act}$ variant of the second algorithm.
Figure 10:
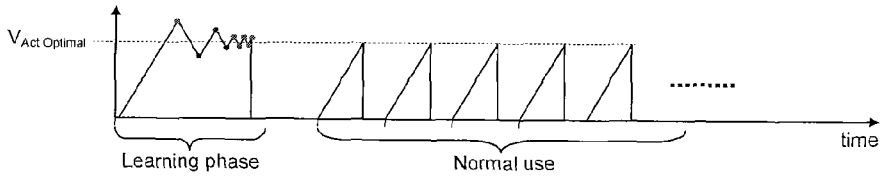
FIG. 10 illustrates another convergence method to optimal actuation voltage.

This method illustrated in FIG. 9 is similar to the previous one with the exception that the first ramp reaches a voltage that is in all cases higher than the optimal voltage. The voltage is the decreased during several steps and the sensor signal, for example the pressure, is monitored simultaneously. As long as the membrane (1) stays in contact with the mechanical stop (2), no significant sensor signal will be monitored. As soon as a sensor signal above a certain threshold is monitored, the membrane (1) is considered no more in contact with the mechanical stop (2) and the previous voltage value is said to be $V_{Act\ Optimal}$.

Other Convergence Methods

The three methods presented above are convergence methods that use sensor data to optimize the voltage value and converge to $V_{Act\ Optimal}$. However, the methods to converge to $V_{Act\ Optimal}$ are numerous and not limited to these three. Also, an algorithm can be used that allows finding the optimal voltage within the shortest time, by using voltage steps $\Delta V$ that start with large values and decrease progressively, following for example a geometric series (½, ¼, ⅛, 1/16, . . . ).

Method 4: Modulation Learning Method

Figure 11:
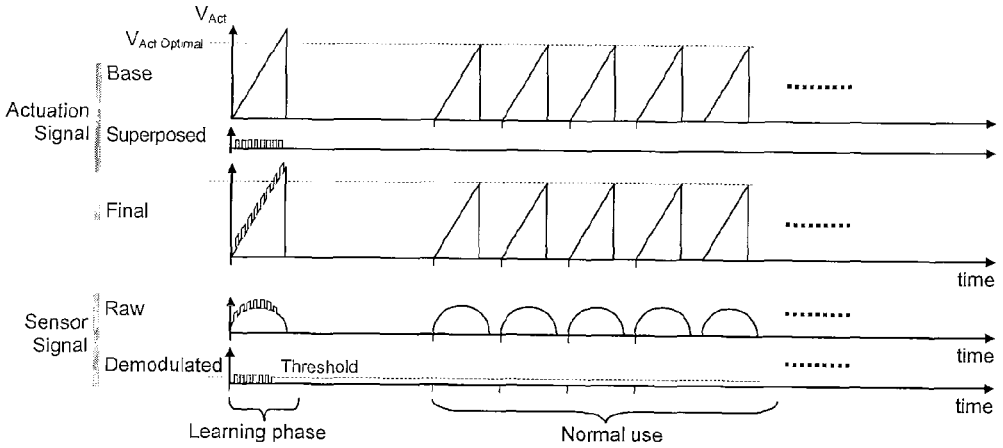
FIG. 11 illustrates the superposition of an actuation signal voltage ramps with convergence to $V_{act\ optimal}$ and FIG. 12 illustrates an application of the signal voltage to a different electrode for a multimorph piezoelectric bender.

This modulation method which is illustrated in FIG. 11 comprises the step of using a fast AC voltage signal that modulates or is superposed to the standard actuation ramp. The sensor signal is then monitored to evaluate its sensibility to the fast AC voltage signal. The sensibility will be high if the membrane (1) hasn't reach the mechanical stops (2), and low if the mechanical stop (2) has been reached. Hence, a threshold can be defined from which the mechanical stops (2) is said to be reached. The voltage of the base ramp at this time is then used as $V_{Act\ Optimal}$. One clear advantage of this method is the robustness against hysteresis, independently from the direction of voltage change of the base actuation signal.

The definition of AC voltage signal is not limited to the square signal represented on FIG. 11 but could be of different forms (triangle, sinusoidal, . . . ), with different amplitudes, duty cycles and frequency. The demodulation of the sensor signal can typically be realized with band-pass filter.

Figure 12:
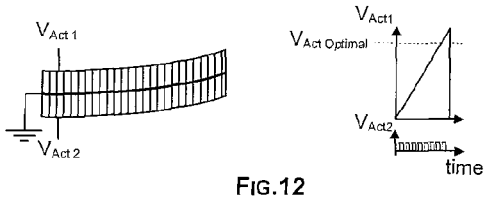

When using a bimorph or a multimorph piezoelectric bender, it is also possible not to apply the AC voltage signal on the electrode that is actuated, but on the other electrode(s), as represented on FIG. 12. The polarisation of the piezoelectric bender is typically oriented perpendicularly to the electrode surface in order to be parallel or antiparallel to the applied electrical field. For negative charge constant $d_{31}$ piezoelectric bimorph benders, the polarization is usually parallel to the electrical field for high field application. The later active layer is then shrunk in its XY plane perpendicular to the electrical field. Since the other layer(s) is (are) usually not powered, it results a lifting of the bender tip when the other end of the bender is clamped or glued or attached by any means. It is possible to apply a small antiparallel electrical field on the other layer(s) to enhance the displacement of the bender tip and to increase the blocking force. The electrical field on the other active layer(s) could be therefore modulated using AC voltage signal in order to perform the search of the optimal voltage on the first layer(s): the main displacement is obtained using the first piezoelectric layer(s) which is submitted to a large electrical field parallel to its polarization (actuation voltage) while a small modulation of the pumping membrane position is obtained by using AC signal (modulation voltage) on the other piezoelectric layer(s). The advantage here is a significant reduction of the power consumption and a complete separation of the electronics into an actuation part and a pulse or modulation part. This method can be extrapolated to any other polarization orientation, piezoelectric materials (PZT . . . ), types (benders . . . ) and shapes (circular, rectangular . . . ), to any electrode configurations and to multimorphs piezoelectric actuators.

The present invention is not limited to the above described embodiments which are given as examples that should not be construed in a limiting manner. Variants are possible with equivalent means and within the scope of the present invention. For example, the method and device of the present invention may be used with other actuators than a piezoelectric actuator as described above.

The invention claimed is:

1. A method for actuating a pumping device with an optimal driving voltage, wherein the pumping device comprises at least a pumping chamber having a pumping membrane, an inlet chamber and an outlet chamber, a voltage controlled actuator connected to said pumping membrane, said pumping membrane reaching at least one stop position defined by a mechanical stop during a pumping stroke at least one sensor for determining whether the pumping membrane has reached said at least one stop position said method comprising a learning phase and a working phase, wherein the learning phase comprises at least the following steps actuation of the pumping membrane by applying a predetermined actuation voltage $V_{act}$ to the actuator, said voltage being either high enough for said pumping membrane to reach said at least one stop position in an over-actuation step or low enough for said pumping membrane not to reach said at least one stop position in an underactuation step;

where if the over-actuation occurs, decreasing the applied actuation voltage until it is determined that the pumping membrane has left said at least one stop position and storing as the optimal voltage $V_{act\ optimal}$ the lowest applied voltage value before the pumping membrane has left said at least one stop position; or where if the under-actuation occurs, increasing the applied voltage until it is determined that the pumping membrane has reached said at least one stop position and storing as the optimal voltage $V_{act\ optimal}$ the lowest applied voltage value when the pumping membrane has reached said at least one stop position;

actuating the pumping device in the working phase with the determined optimal voltage $V_{act\ optimal}$.

2. A method as defined in claim 1, wherein the inlet chamber and the outlet chamber of the pumping device comprise passive valves.

3. A method as defined in claim 1, wherein if the overactuation occurs a sensor is enabled, simultaneously or not to a pumping process, to record along time one or multiple data points, forming a nominal pattern that corresponds to a nominal stroke;

for each subsequent pump stroke, the actuation voltage $V_{act}$ is decreased progressively with a predefined step $\Delta V$, for each decrease of actuation voltage, a measured pattern is compared to the nominal pattern, which allows detecting if the pumping membrane still reaches the at least one stop position or not;

when a difference between the measured pattern and nominal pattern is higher than a defined threshold, it is determined that the pumping membrane does not reach said at least one stop position anymore, wherein when It is determined that the pumping membrane does not reach the at least one stop position, the last voltage value is said to be the lowest voltage leading to a correct and precise pump stroke, and it is stored as $V_{act\ optimal}<V_{actMax}$; and for each subsequent pump stroke, $V_{act}$ optimal voltage is used, thus ensuring a minimum power consumption and an optimal pumping effect.

4. A method as defined in claims 1, wherein if the under-actuation occurs after a certain time period Δt that ensures mechanical stabilization of the system, an increase of voltage ΔV is applied;

simultaneously or not to the voltage increase, the at least one sensor is enabled to record along time one or multiple data points;

wherein the data points are then processed to determine if the voltage increase induced a displacement of the actuator;

if a displacement is sensed, it is determined that the at least one stop position was not reached yet because the actuator has moved following two successive voltage increases and a subsequent increase in voltage occurs;

if no displacement is sensed, it is determined that the actuator has reached the at least one stop position so that voltage increases have no effect, the last voltage increase was useless, and the precedent voltage is set as $V_{act\ optimal}$ wherein for all subsequent pump strokes, $V_{act\ optimal}$ voltage is used, thus ensuring a minimum power consumption and an optimal pumping.

5. A method as defined in claim 3, wherein the sensor records data corresponding to flow, or to pressure in a fluidic path, or to the position of the pumping membrane, or to strain on the mechanical stop, the pumping membrane, or the actuator.

6. A method as defined in claim 1, where if the over-actuation occurs, voltage decreasing steps vary progressively, where if the under-actuation occurs, voltage increasing steps vary progressively.

7. A method as defined in claim 6 wherein the initial steps a larger than the subsequent steps.

8. A method as defined in claim 1, wherein a modulation voltage is superimposed to the applied actuation voltage, wherein said modulation voltage has an amplitude at least two times smaller than the actuation voltage, wherein said modulation voltage has a frequency at least two times higher than the actuation voltage, and wherein a sensor data is monitored to evaluate its sensitivity to the modulation voltage signal such that the sensitivity is high if the pumping membrane has not reached the at least one stop position and the sensitivity is low if the pumping membrane has reached the at least one stop position.

9. A method as defined in claim 1, wherein the actuator (6) is a piezoelectric actuator.

10. A method as defined in the claim 9, wherein the piezoelectric actuator comprises at least two actives layers, wherein the actuation voltage is applied onto the electrodes of a first active layer, wherein the modulation is applied onto the electrodes of a second active layer, wherein said modulation voltage has an amplitude at least two times smaller than the actuation voltage amplitude, and a frequency at least two times higher than the actuation voltage frequency , and wherein the sensor data is monitored to evaluate its sensitivity to the modulation voltage signal such that the sensibility is high if the pumping membrane has not reached the mechanical stop and the sensibility is low if the pumping membrane has reached the mechanical stop.

11. A method as defined in claim 1, wherein the method is executed during a priming of a pump or it is repeatedly executed to take into account changes in a pump system.

12. A pumping device with an optimal driving voltage, wherein the pumping device comprises at least a pumping chamber having a pumping membrane, an inlet chamber and an outlet chamber, an actuator connected to a pumping membrane, said pumping membrane reaching at least one stop position defined by a mechanical stop during a pumping stroke at least one sensor for determining whether the membrane has reached said at least one stop position treatment means to store and process data;

wherein said device is able to carry out the method as defined in claim 1.

13. A pumping device as defined in the claim 12, wherein the voltage controlled actuator is a piezoelectric actuator.

14. A pumping device as defined in claims 12, wherein the inlet chamber and/or the outlet chamber are/is valve(s).

15. A pumping device as defined in claim 14, wherein the valves are passive check valves.

16. A pumping device as defined in claim 12, wherein the pumping chamber has two mechanical stop.

17. A pumping device as defined in claim 12, wherein the at least one sensor comprises at least one pressure sensor.

18. A pumping device as defined in claim 17, wherein the at least one sensor comprises at least one pressure sensor located within the pumping chamber.

* * * * *